US007380510B2

(12) United States Patent
Stucki et al.

(10) Patent No.: US 7,380,510 B2
(45) Date of Patent: Jun. 3, 2008

(54) DEVICE FOR OPERATING SEVERAL FUNCTIONS OF A SEWING MACHINE

(75) Inventors: André Stucki, Steckborn (CH); Roland Füllemann, Berlingen (CH)

(73) Assignee: Fritz Gegauf Aktiengesellschaft Bernina-Nahmaschinenfabrik, Steckborn (CH)

( * ) Notice: Subject to any disclaimer, the term of this patent is extended or adjusted under 35 U.S.C. 154(b) by 294 days.

(21) Appl. No.: 11/398,072

(22) Filed: Apr. 5, 2006

(65) Prior Publication Data

US 2006/0249063 A1 Nov. 9, 2006

(30) Foreign Application Priority Data

May 9, 2005 (CH) ..... 0816/05

(51) Int. Cl.
*D05B 69/26* (2006.01)
*D05B 65/00* (2006.01)
*D05B 57/30* (2006.01)

(52) U.S. Cl. ..... 112/274; 112/299; 112/186; 112/323

(58) Field of Classification Search ..... 112/274, 112/285, 185, 186, 316, 162, 314, 122, 180, 112/323, 288, 299, 270; 16/DIG. 30; D08/301
See application file for complete search history.

(56) References Cited

U.S. PATENT DOCUMENTS

| | | | | |
|---|---|---|---|---|
| 3,137,257 | A * | 6/1964 | Caron | 112/464 |
| 3,636,900 | A * | 1/1972 | Rogers et al. | 112/316 |
| 4,434,733 | A * | 3/1984 | Weisz | 112/450 |
| 5,806,448 | A * | 9/1998 | Matsuo et al. | 112/162 |
| 6,082,279 | A * | 7/2000 | Ito et al. | 112/314 |
| 6,101,960 | A * | 8/2000 | Ebata et al. | 112/122 |
| 7,055,444 | B2 * | 6/2006 | Stucki et al. | 112/180 |

FOREIGN PATENT DOCUMENTS

| | | |
|---|---|---|
| DE | 103 21 538 | 12/2003 |
| FR | 2 455 109 | 11/1980 |
| FR | 2 537 617 | 6/1984 |
| FR | 2 538 422 | 6/1984 |

* cited by examiner

*Primary Examiner*—Ismael Izaguirre
(74) *Attorney, Agent, or Firm*—Volpe and Koenig, P.C.

(57) ABSTRACT

A device for operating several sewing functions is provided with a single control disk with curved paths arranged peripherally and facially on the control disk for acting radially and axially. The control disk is driven by a stepper motor and allows individual or several functions to be executed during the rotary movement as well as temporarily stopping others.

8 Claims, 7 Drawing Sheets

DEVICE FOR OPERATING SEVERAL FUNCTIONS OF A SEWING MACHINE

BACKGROUND

The invention relates to a device for operating several functions of a sewing machine.

In order to increase the sewing comfort, modern sewing and knitting machines are provided with a multitude of partially or fully automated functions previously performed by hand. Individual functions can be triggered by operating a lever or a push button. Other functions need to be performed temporarily exactly adjusted to one another, in order to avoid collisions of machinery parts or the like. On the one hand, appropriate supervisory, safety, and control means are necessary, and, on the other hand, the respective mechanical drives for performing the individual functions are also required. Individual drives can be used, which control the allocated functions. This leads to higher production costs and a correspondingly high control and space requirement within the machine housing.

SUMMARY

The object of the present invention is to provide a device, which allows several functions to be simultaneously performed and/or performance in a synchronized manner and/or to interrupt the functions intermittently using a single drive element.

This object is attained in a device with the features according to the invention. Advantageous embodiments of the invention are described below.

Using a cam disk, which is provided with curved paths not only peripherally but also at its faces, which act both radially as well as axially, drive functions can be superimposed and/or temporarily switched on and/or interrupted through a certain turning range. A particularly advantageous embodiment of the invention allows triggering of functions with a single cam disk or control disk, ranging over a rotation of more than 360° on the shaft supporting the control disk. All functions can therefore be performed on the very same shaft and powered by a single drive. The individual functions are automatically performed at a synchronized progression so that faulty manipulations, which might result in damages of the sewing machine, are excluded.

BRIEF DESCRIPTION OF THE DRAWINGS

Using the illustrated exemplary embodiment for three functions the invention is explained in greater detail. Shown are.

DETAILED DESCRIPTION OF THE PREFERRED EMBODIMENTS

Figure 1:
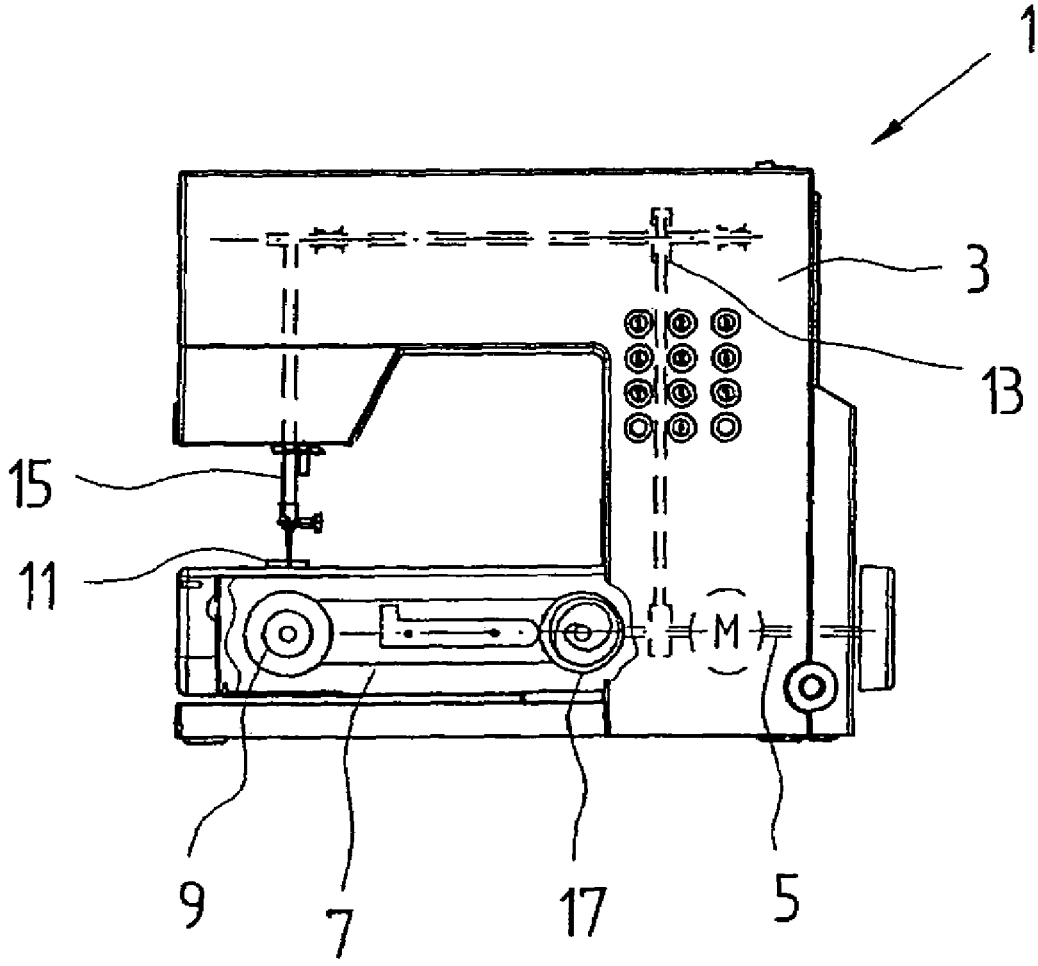
FIG. 1 is a schematic view of a domestic sewing machine with a partial section of the lower arm in the area of the hook.

In the schematic representation according to FIG. 1, only the elements in a domestic sewing machine 1 necessary for understanding the invention are shown and briefly described.

A drive motor M is arranged in the machine housing 3, which drives the hook 9 and the transporter 11 via a primary shaft 5 in the lower arm 7. The drive of the needle rod 15 occurs via an upper drive 13. Furthermore, a control disk 17 is used in the lower arm as an element performing a multitude of functions. In the following, the construction and the functions of the control disk 17 are explained in greater detail.

Figure 3:
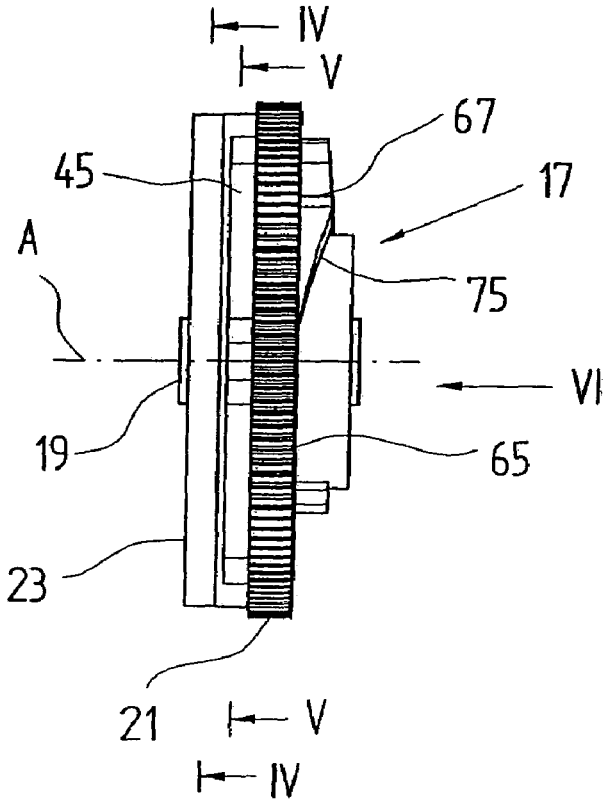
FIG. 3 is a side view of a control disk.

The control disk 17 according to FIG. 3 comprises a central pivot bearing, e.g., in the form of a bushing 19 and a peripherally arranged sprocket 21 for driving the control disk 17. Alternatively, the drive of the control disk 17 may also occur by a drive, which is connected to a shaft in a form-fitting manner, itself fixed to the control disk 17, or with a rotary motor, with its rotor being formed by the control disk 17 and its stator by a fixed shaft. Both alternative embodiments are not shown.

Figure 4:
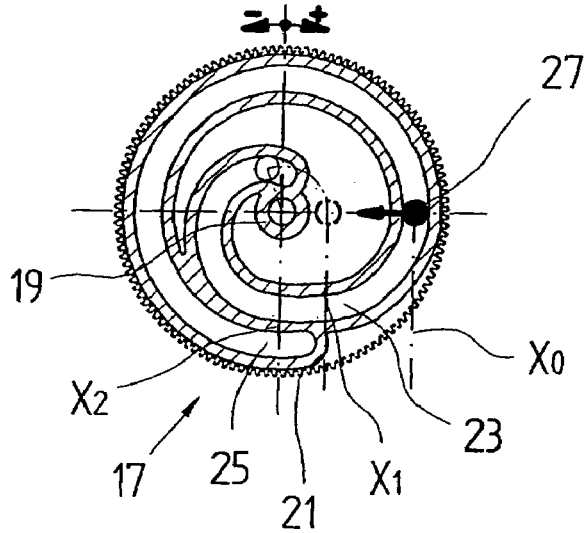
FIG. 4 is a cross-section through a control disk along a line IV-IV in FIG. 3.

At the first face 23 of the control disk 17 (cf. FIG. 4) a guide groove 25 is provided, partially circular and partially helical, which extends over an angle of more than 360°; in the present example over an angle of approximately 540°. The guide groove 25 extends over the first 270° with a constant radius, i.e. circular. The subsequent angular range of approximately 270° extends helically, i.e. the radius essentially reduces continuously. A control pin 27 engaging the guide groove 25 remains therefore in the first guiding section with a constant radius in its original position $x_0$ and it does not move. Only at another rotary movement counter clockwise the control pin is guided out of the original position $x_0$ into the intermediate position $x_1$ and further into the final position $x_2$. Depending on the change of the radius of the groove 25 per angular unit the progression of the movement of the machine elements connected to the control pin 27 can be determined. The control pin 27 is connected to a slide bar 35, not shown in FIG. 4, but discernible in FIG. 7. A suitable horizontal guidance 29 for said slide bar 35 is also discernible in FIG. 7. The horizontal guidance 29 is not transferred by the control pin 27 but by a guide pin 31. For this purpose, a horizontal guide groove 29 is recessed in a carrier 33, which carrier 33 also supports the hook 9.

The control pin 27 and the guide pin 31 are connected to the slide bar 35, which at its front end 36 has an angled toothed segment 37 arranged pivotal on the carrier 33. The toothed segment 37 engages the rear, toothed end 40 of a thread cutting device 39 in a comb-like manner. The cutting edge 41 at the front end 42 of the thread cutting device 39 contacts laterally of the thread exit opening 44 of the hook 9.

Using the thread cutting device 39, the bottom thread can be cut at a suitable distance from the thread exit opening 44. The end of the thread extending out of the hook 9 is still provided with a length sufficient for ensuring the sewing of new fabric to be sewn.

In another embodiment of the thread cutting device 39, the upper thread can also be cut. The operation of the thread cutting device 39 is not an object of the present invention and therefore it is not explained in greater detail, here. In the following, the thread cutting device will be described in greater detail and together with the two other functions of the control disk 17.

Figure 7:
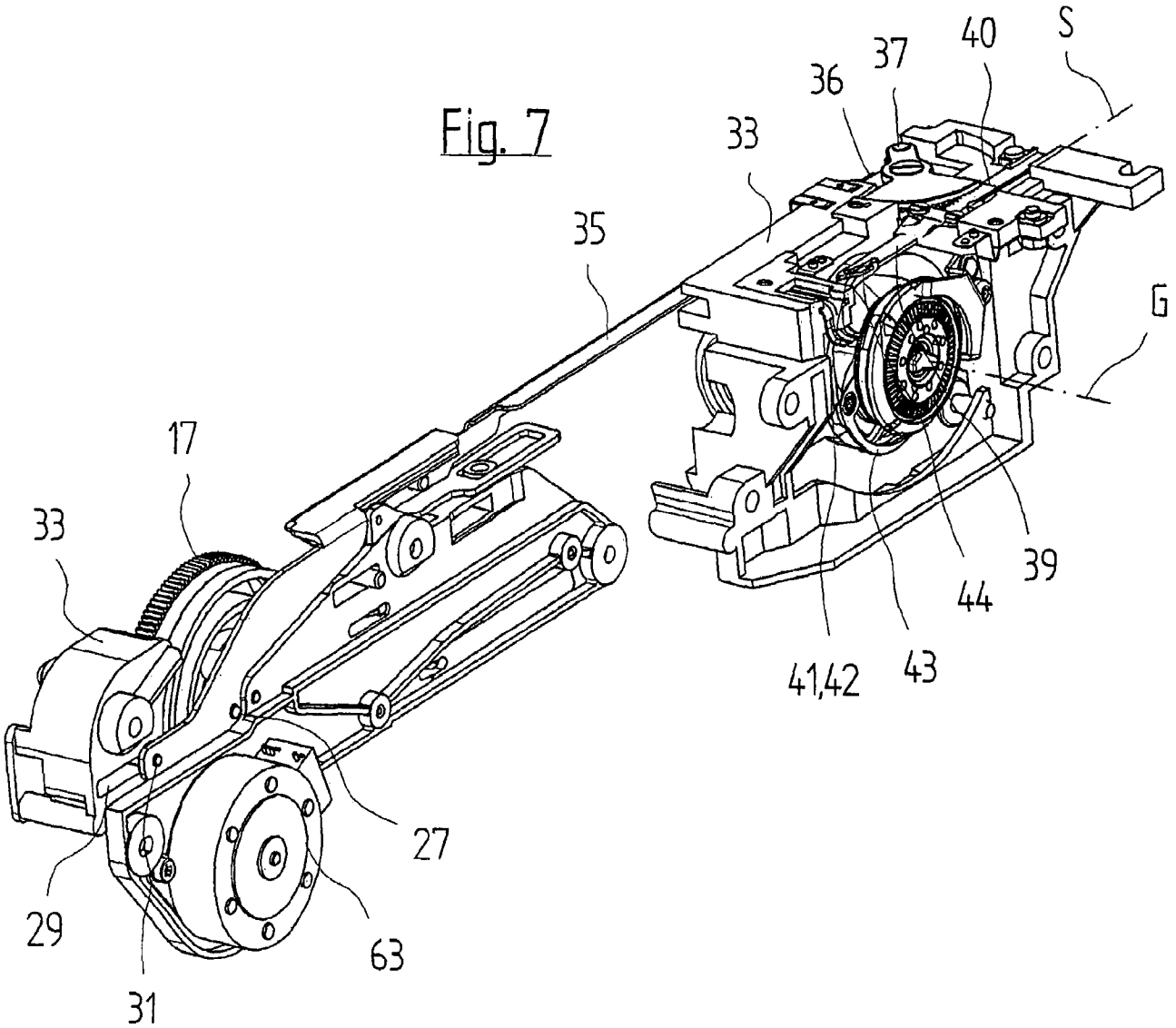
FIG. 7 is a perspective representation of the drive organs for a thread cutter.

In the example shown, the hook 9 is supported on a rotational axis G on the carrier 33 such that it can be rotated and driven. The drive of the hook 9 is not shown, because in FIG. 7 it is covered by the carrier 33. In this embodiment of the invention, the hook 9 is pivotal around a pivotal axis S vertically arranged in reference to the rotational axis G of the hook 9, in order to optimally design the bobbin exchange of the bottom thread for the operating personnel. For the bobbin exchange of the bottom thread the hook 9 pivots from the operational position shown in FIG. 7 into a thread bobbin—removal position, pivoted by approximately 180°. In other words, the face of the thread hook 43 seen in FIG. 7 is positioned, after the pivotal motion, at the rear side of the carrier 33 and is freely accessible from the front side of the sewing machine 1 by the person sewing.

Figure 5:
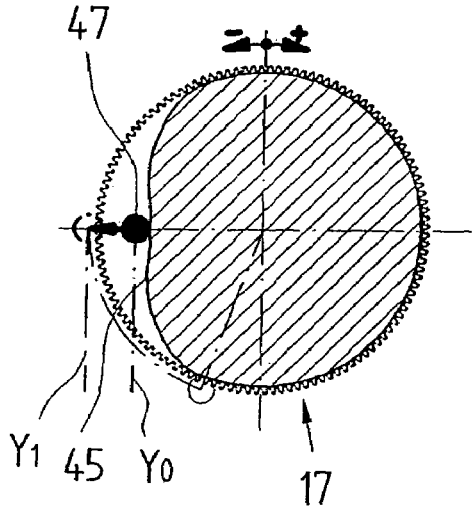
FIG. 5 is a cross-section through a control disk along a line V-V in FIG. 3.

In FIG. 5, a control curve 45 is discernible that is kidney-shaped and peripheral on the control disk 17. A sensor finger 47 represented by a black dot in the cross-section is moved, based on the curved form, during the rotation of the control disk 17 from an original position $y_0$ into an end position $y_1$ and back into the original position $y_0$. Here, in the exemplary embodiment shown, the entire horizontal shift occurs already by an angular rotation of approximately 75° in a positive and negative rotary direction.

Figure 8:
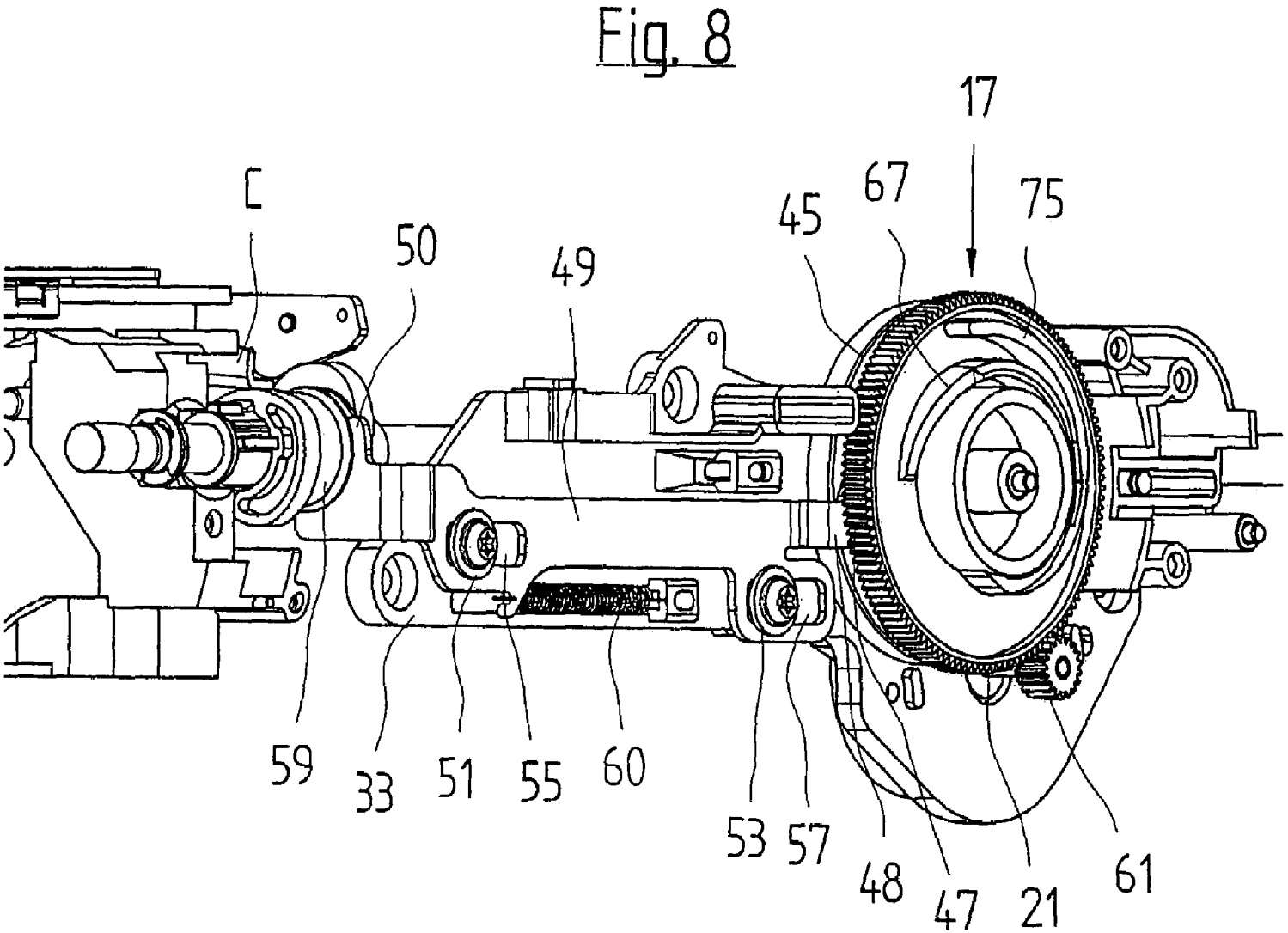
FIG. 8 is a perspective representation of the drive elements and the operational elements for a lowering motion of the transporter.

The sensor finger 47 engaging the control curve 45 is arranged at the rear end 48 of a lifting rod 49 positioned horizontally on the carrier 33 supported in a shiftable manner (cf. FIG. 8). The lifting rod 49 is longitudinally guided, for example, at two threaded screws 51, 53, which penetrate the lifting rod 49 in two oblong holes. A tensile spring 60 suspended at the lifting rod 49 serves to continuously press the sensor finger 47 firmly against the control curve 45. The front end 50 of the lifting rod 49 engages at a lowering element 59 for the transporter, known from prior art and not described in greater detail. Rotating the control disk 17 by approximately 75° causes the transporter 11 to be transferred form the operational position into a resting position, in which its teeth cannot extend beyond the surface of the stitching plate at the lower arm 7.

Figure 10:
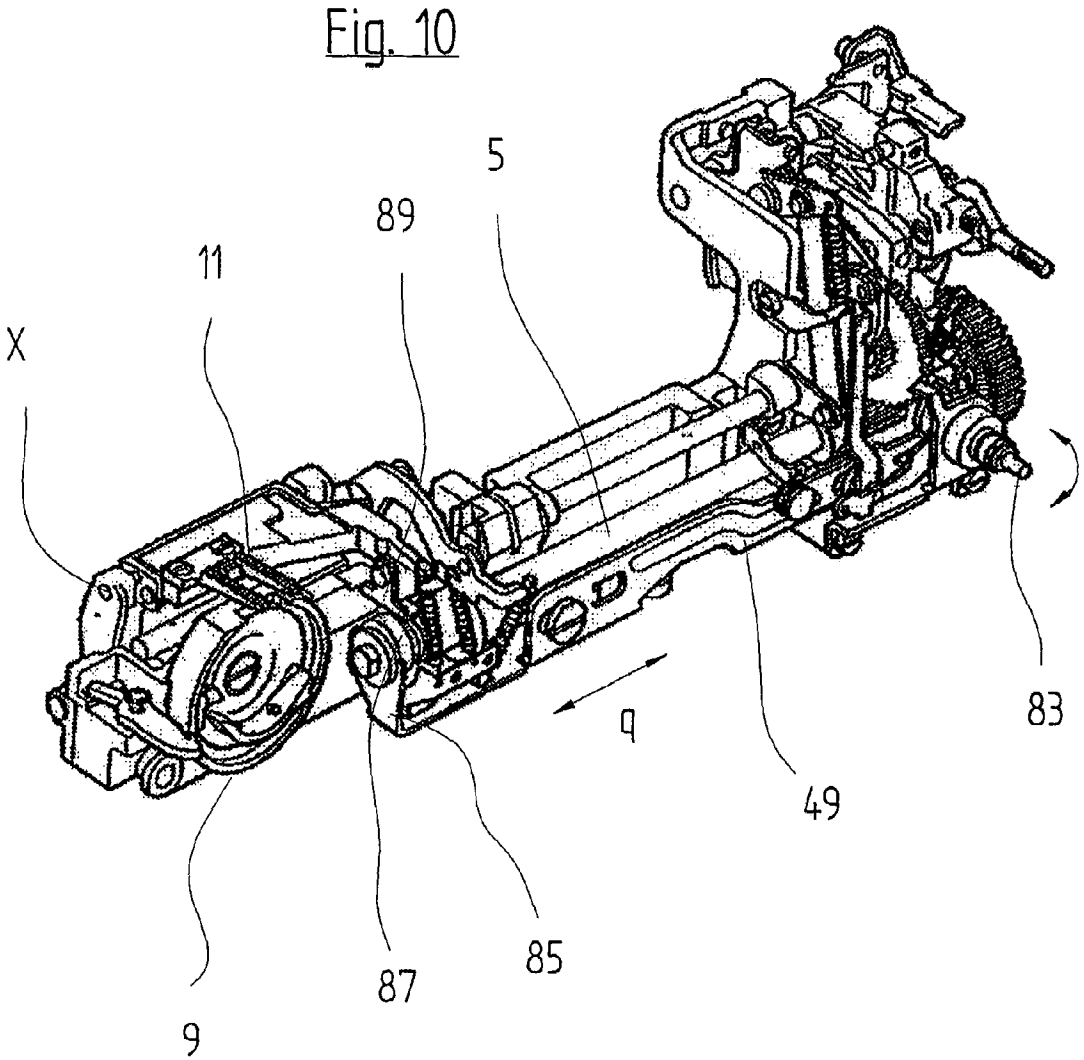
FIG. 10 is a perspective view of the lowering device for the transporter.

For clarification purposes, in FIG. 10 a conventional device for lowering the transporter 11 is shown in a perspective representation. The same reference characters are used as in the device according to the invention. Using a rotational knob 83, with either a lever drive or a sprocket drive being arranged at its rear end (not shown), the lifting rod 49 at its one end is moved in the direction of the arrow q, at which the sensor finger 47 is arranged according to the invention. This movement causes a curved disk 87 to be displaced axially by a fork 85 formed at the opposite end of the lifting rod 49, and thus it is guided out of the area of the sensor finger 89, which is supported on the curved disk. This way, the transporter can pivot in the clockwise direction by a pivotal motion around a rotary axis X and thus arrives under the stitching plate at the lower arm 7 of the sewing machine. In FIG. 8 it is further discernible, how a drive sprocket 61 below the sprocket 21 engages, which is supported on a drive motor 63 (see FIG. 7). Using this drive motor 63, e.g., a stepper motor, the control disc 17 is controlled by the sewing machine control via the sprocket 21, and can be set in motion in the positive or negative rotational direction.

Figure 6:
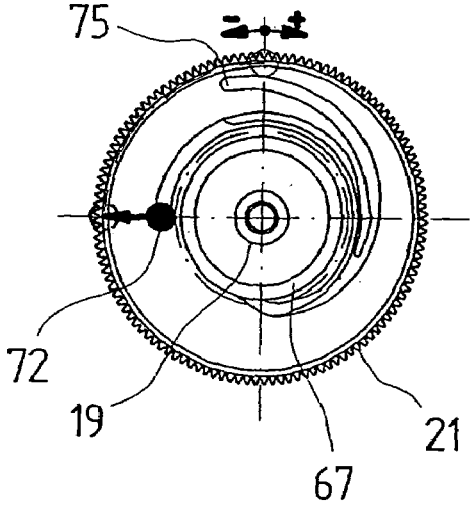
FIG. 6 is an axial view of the control disk from the direction of the arrow VI in FIG. 3.
Figure 9:
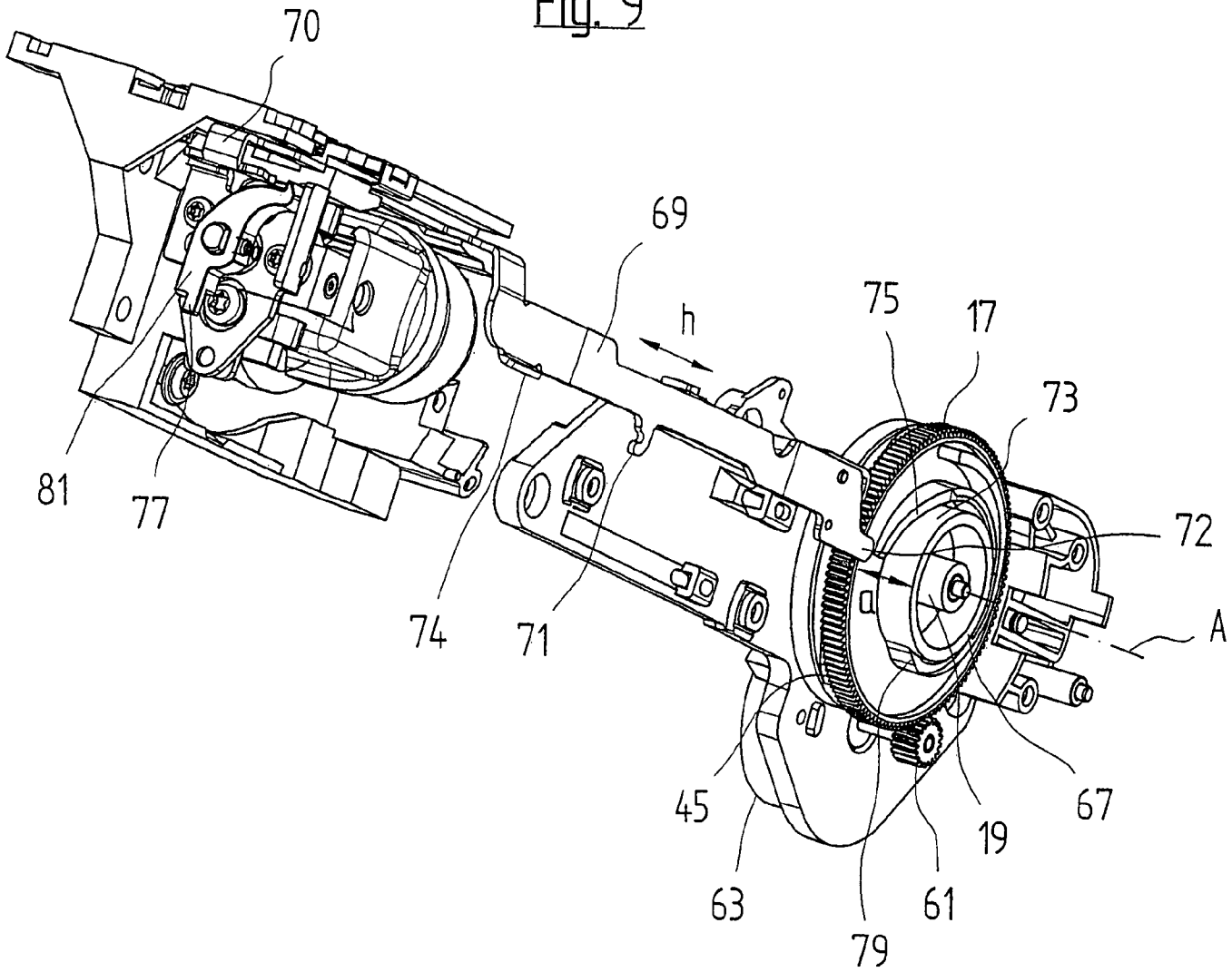
FIG. 9 is a perspective representation of the drive elements for locking the hook.

On the control disk 17, on the second face 65 visible in FIGS. 8 and 9, another three-dimensional control path 67 is provided. The latter serves to move a control rod 69 in a predetermined temporal progression in the longitudinal direction h and, at certain rotational angular sections of the control path 67, also to move it in the axial direction in reference to the control curve (cf. arrows a). The control rod 69 contacts with its front end, embodied as a sensor head 72, the peripheral control path 67. The control rod 69 is continuously pressed against the peripheral control surface 73 by a tensile spring (not shown) suspended at a hook 71 (cf. FIGS. 6 and 9). A second spring, not shown either, engages a second hook 74 and pulls the control rod 69 to the face of the control disk 17 and/or to the control path 75 acting axially at the face. Thus, the radially extending control path 67 causes a movement of the control rod 69 in the direction h and the facial control path 75 leads the control rod 69, beginning at a certain rotational angle, out of the radial control path 67 so that, in spite of an additional rotation of the control disk 17, no additional motion can occur in the direction h. The rear end 70 of the control rod 69 contacts a locking lever 77. The locking lever 77 ensures that in its operational position the hook 9 is located exactly below the needle and is locked. In the bobbin exchange position the hook 9 is held by the locking mechanism.

Figure 2:
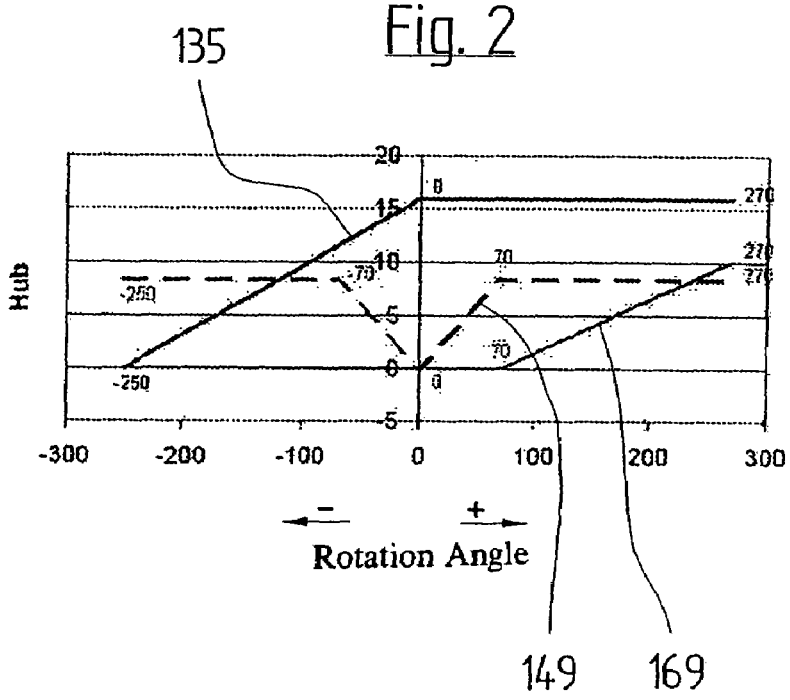
FIG. 2 is a path/time diagram of three sewing functions.

In the graphic representation in FIG. 2, the driving paths of the three individual elements caused by the rotation of the control disk 17 are shown depending on the rotational angle of the control disk 17.

In the drawing, the thick, continuous curve 135 shows the progression of the motion of the slide bar 35, by which the cutting device for the bottom thread is activated. The curve 149 represented in dot-dash lines shows the progression of the lifting rod 49 for lowering the transporter and a finely drawn curve 169 shows the driving path of the control rod 69 for locking the pivotal motion of a carrier supported on the hook 9.

Based on this path/time-diagram according to FIG. 2, the function of the control disk 17 is explained in the following.

If the operating person intends to work without the transporter 11 for the material drive, e.g., during quilting or mending, rotating the control disk 17 by a positive rotational angle of 70° can lower the transporter 11. Here the two other functions, namely the thread cutting and the unlocking of the hook 9 are not activated, because during the rotational motion of the control disk 17 by approximately 70°, the control pin 27 for the thread cutting device 39 and the sensor head 72 for the hook lock are not moved by the control disk 17 over this rotary range (70°). Only the sensor finger 47 is displaced laterally out of the position $y_0$ into the position $y_1$ by the control curve 45, with a kidney-shaped, and causes the lowering of the transporter 11 via the lifting rod 49.

If at the end of the sewing process the bottom thread and, depending on the embodiment of the thread cutting device 39 the upper thread as well, are to be cut, the control disk 17 is rotated in the negative direction, i.e. counter clock-wise, for example by 250°. Here, the slide bar rod 35 operates, driven by the control pin 27, the cutting device 39 via the toothed segment 37. Simultaneously, i.e. synchronized thereto, at the beginning of the rotational movement the transporter 11 is lowered because the sensor finger 47 is also shifted by the kidney-shaped control path 45, in the negative rotational direction as well, out of the operational position into a resting position. The lowering of the transporter 11 is therefore advantageous for cutting threads as well, because here the guiding away of the material between the sewing foot and the stitching plate is not hindered by the teeth of the transporter 11. Additionally, the threads cannot become caught in the transporter 11.

If prior or during the sewing process the bottom bobbin needs to be exchanged because the supply of bottom thread is used up or another thread is required, the rotation of the control disk 17 occurs in the positive rotational direction. During, for example, the first 70 degrees of the rotation the transporter 11 lowers again, because the sensor finger 47 is activated by the control curve 45. The thread cutting device 39 is not activated by this rotary movement, because the control pin 27 is located in the guide groove section 25, which has a constant radius. After crossing a rotary angle of, for example 70°, the sensor finger 47 also reaches the range of the control curve 45 having a constant radius for lowering the transporter. Therefore, no other movements occur.

However, the control rod 69 and/or the sensor finger 47 positioned at the front end is displaced in the longitudinal direction by facially contacting a ramp 79 extending helically and acting radially. The longitudinal displacement towards the left causes the loosing of a catch 81, which safely locks the hook 9 in the operational position. In order to suppress this function during the reverse rotation, i.e. when cutting threads, when the control disk 17 occupies the same position, the control rod 69 is diverted by the facial control 75 in the axial direction in reference to the control disk 17, without influencing the position in the longitudinal direction. This way, the hook lock can only be loosened by a rotation of the control disk 17 in the positive direction.

LIST OF REFERENCE CHARACTERS

1 Sewing machine
3 machine housing
5 primary shaft
7 lower arm
9 hook
11 transporter
13 upper drive
15 needle rod
17 control disk
19 socket
21 sprocket
23 $1^{st}$ facial surface
25 guide groove
27 control pin
29 horizontal guide
31 guide pin
33 carrier
35 slide bar
36 frontal end of 35
37 tooth segment
39 cutting device
40 rear end of 39
41 cutting edge
42 frontal end of 39
43 thread hook
44 thread exiting opening at 43
45 control curve
47 sensor finger
48 rear end of 49
49 lifting rod
50 frontal end of 49
51 threaded screw
53 threaded screw
55 oblong holes
57 oblong holes
59 lowering element
60 tensile spring
61 drive sprocket
63 drive motor
65 $2^{nd}$ facial surface
67 radial control path
69 control rod
70 rear end of 69
71 $1^{st}$ hook
72 sensor head
73 control surface
74 $2^{nd}$ hook
75 facial control path
77 locking lever
79 ramp
81 catch
83 rotational knob
85 fork
87 curved disk
89 sensor finger
135 curve
149 curve
169 curve

The invention claimed is:

1. A device for operating several functions of a sewing machine, comprising a single drive element, with a control disk (17) having curved paths (45, 67) arranged at a face and a periphery thereof, with the curved path on the face comprising contact surfaces acting both radially as well as axially, and with the control disk (17) being connected to a driving motor (63) and being rotated thereby in both rotational directions.

2. A device according to claim 1, wherein at least one of the facially arranged curved paths (25) extends over a rotary angle of more than 360°.

3. A device according to claim 2, wherein at least one of the facial, curved paths (25) extends helically on a first partial path and circular on a second partial path.

4. A device according to claim 1, wherein sensor elements contact the curved paths (45, 67) in a gliding manner radially and/or axially.

5. A device according to claim 4, wherein the sensor elements are provided at ends of control or lifting rods (69, 49) and switch the control or lifting rods (69. 49) on or off.

6. A device according to claim 5, wherein at least the curved path which acts axially can guide one of the lifting rods without engaging a radially acting curved path.

7. A device according to claim 2, wherein at least one of the curved paths (25) positioned at the face comprises open and/or closed partial path sections.

8. A device according to claim 2, wherein the angle is more than 540°.

* * * * *